United States Patent [19]

Klaassen

[11] 3,978,625

[45] Sept. 7, 1976

[54] GRINDING WHEEL COOLANT NOZZLE

[75] Inventor: William P. Klaassen, Brooklyn, Mich.

[73] Assignee: Teer, Wickwire & Company, Jackson, Mich.

[22] Filed: Feb. 18, 1975

[21] Appl. No.: 550,756

[52] U.S. Cl. ..... 51/267; 51/322

[51] Int. Cl.[2] ..... B24B 55/02; B24B 1/00

[58] Field of Search ..... 51/266, 267, 356, 322

[56] References Cited

UNITED STATES PATENTS

| | | | |
|---|---|---|---|
| 2,950,578 | 8/1960 | Fouquet | 51/267 |
| 3,325,949 | 6/1967 | Fisher | 51/267 |
| 3,334,451 | 8/1967 | Hutton | 51/267 |
| 3,834,088 | 9/1974 | Matson | 51/267 |

*Primary Examiner*—Al Lawrence Smith
*Assistant Examiner*—Nicholas P. Godici
*Attorney, Agent, or Firm*—Beaman & Beaman

[57] ABSTRACT

The invention pertains to a nozzle for applying a liquid coolant to the grinding surfaces of a rotating grinding wheel wherein the nozzle removes the moving air film and loose particles immediately adjacent the grinding wheel surface before cooling the surface with the liquid coolant. The moving air film and loose particles adjacent the wheel grinding surfaces are removed by a flow of coolant liquid directed in a direction at least partially counter to the direction of grinding wheel surface movement, and to minimize the reoccurrence of the surface air film after removal thereof the grinding wheel surfaces are partially shielded and baffled immediately prior to application of the coolant liquid thereto for cooling purposes. Further, the application of coolant liquid for cooling purposes occurs immediately prior to engagement of the grinding surfaces with the workpiece, before a significant surface air film can occur.

6 Claims, 3 Drawing Figures

FIG. 1
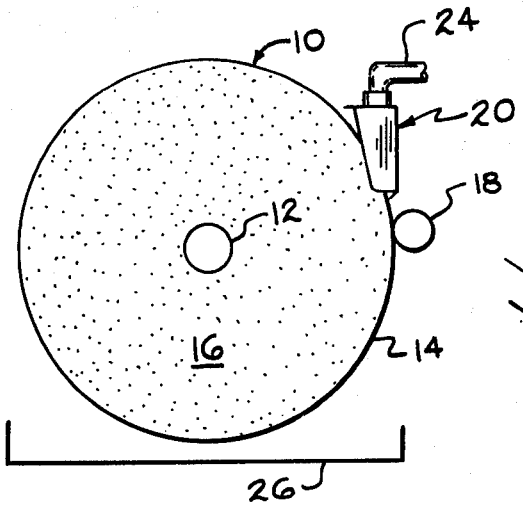
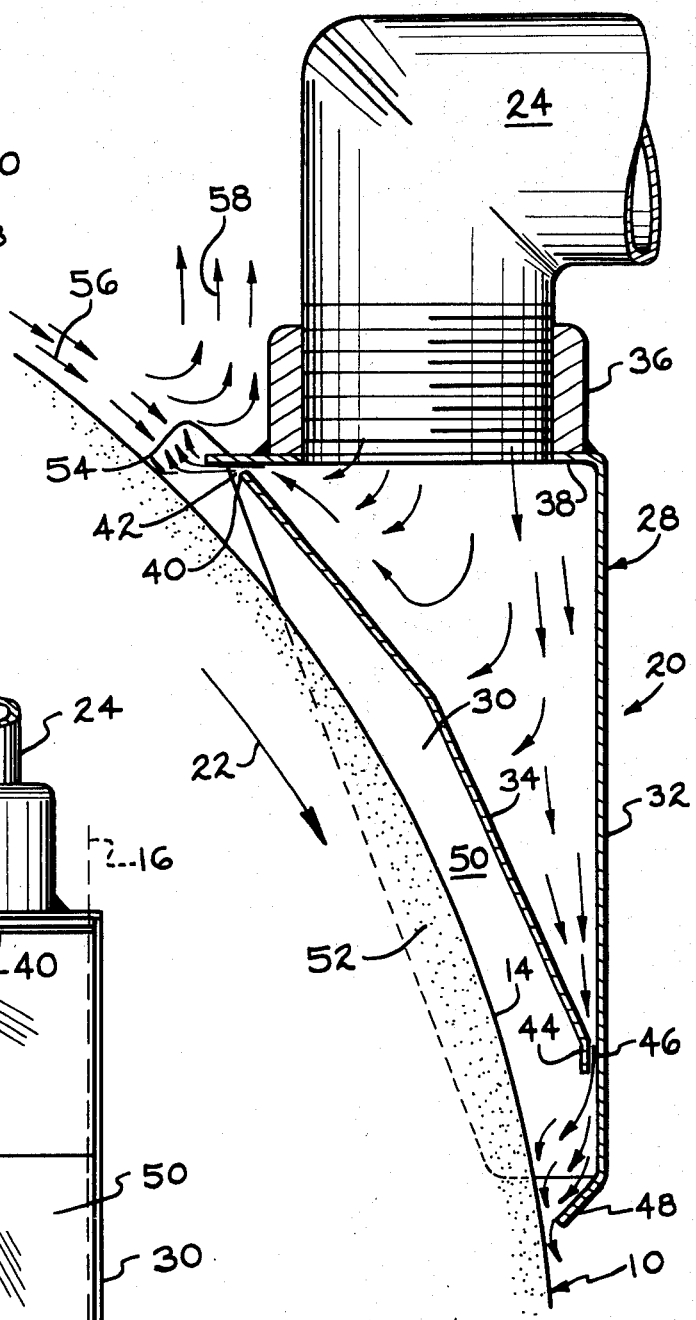
FIG. 2
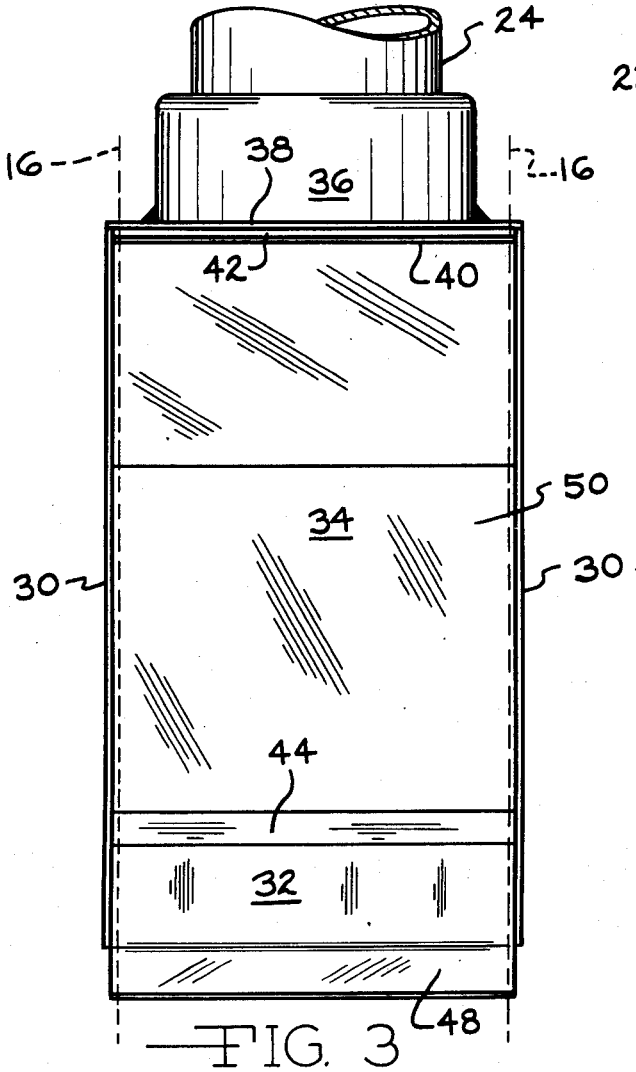
FIG. 3

GRINDING WHEEL COOLANT NOZZLE

BACKGROUND OF THE INVENTION

The invention pertains to nozzles for directing liquid coolants upon the grinding surfaces of rotating grinding wheels.

It has long been recognized that machining operations accomplished by grinding, i.e., the engagement of a workpiece with a rotating surface of abrasive material, such as Carborundum, can be improved by the generous use of cooling liquids. Accordingly, a wide variety of cooling liquids are available for grinding operations ranging from plain water to sophisticated petroleum products. Most grinding machines, such as centerless grinders, wherein high quality finishes are produced by grinding operations require that the workpiece be flushed with liquid coolant during grinding, and a number of devices have been produced for applying the liquid coolant to the grinding wheel and workpiece.

As the surface of the grinding wheel engaging the workpiece will increase in temperature during the operation, a number of coolant applying devices and nozzles have been produced such as typified by U.S. Pat. Nos. 2,475,811; 2,914,892; 3,256,647 and 3,712,001. One of the purposes of such patents as these is to maintain the maximum amount of cooling liquid upon the grinding wheel periphery to increase the cooling ability of the grinding surface. However, one of the serious problems preventing effective cooling of grinding wheel surfaces is due to the fact that the grinding wheel is rapidly rotating during most conventional grinding applications, and this rapid rotation causes a moving air film to occur immediately adjacent the grinding surfaces which acts as an insulating barrier and shield between the grinding surfaces and the coolant applied to the grinding wheel. The insulating characteristics of air are relatively high, and thus a liberal flushing of a grinding wheel with a liquid coolant is only partially effective in reducing the temperature of the grinding wheel surfaces due to the existence of the surface air film.

It has been proposed to divert this surface air film from the wheel grinding surfaces by the use of mechanical means, such as a doctor blade, and such an arrangement is shown in U.S. Pat. No. 3,325,949. However, such an arrangement, though partially effective, is not capable of completely removing the laminar air film due to the necessary clearance that must exist between the doctor blade and the grinding surface, and the continual change in the diameter of the grinding wheel, due to wear, renders the maintaining of a close dimensional relationship between a doctor blade and the grinding surfaces difficult.

A further difficulty arising from grinding operations results from the presence of minute loose particles which remain on the grinding wheel surface after engagement with the workpiece which are not removed therefrom by the coolant liquid, or the centrifugal forces acting upon the grinding wheel. Such loose particles consist of the metal removed from the workpiece, and particles of the grinding wheel itself, which, during wear, slowly disintegrates. As such small particles remain upon the grinding surfaces, and are successively interposed between the grinding wheel cutting edges and the workpiece, a galling of the workpiece surface occurs which detracts from the quality of the ground workpiece surface, and in instances wherein very high quality ground finishes are necessary, secondary burnishing or grinding operations may be necessary to achieve the quality of finish desired.

In the past, the removal of such loose particles from the grinding wheel grinding surfaces has been limited to liberally flushing the grinding wheel surfaces with coolant liquid endeavoring to wash away such particles. The coolant liquid distribution system usually includes a filter for removing small particles from the coolant liquid, but unless the minute loose particles retained within the voids of the grinding wheel surfaces are removed, optimum ground surfaces cannot be machined.

BRIEF DESCRIPTION OF THE INVENTION

The invention pertains to a liquid coolant applying nozzle for use with rotating grinding wheels, such as those used on centerless grinders and the like, wherein the nozzle utilizes a flow of coolant liquid in a direction at least partially counter to the direction of grinding wheel surface movement to remove the moving air film adjacent the grinding surface, and simultaneously remove loose particles which may be located on the grinding surface. Sequentially, after the air film and loose particles have been removed from the grinding surface, a liquid coolant is applied to the grinding wheel grinding surface to cool the same, and the grinding surface is engaged with the workpiece being machined immediately after application of the cooling coolant and prior to reoccurrence of a moving air film adjacent the grinding surface.

A further object of the invention is to shield the grinding wheel grinding surface intermediate the removal of the surface air film and loose particles by closely fitting shields and baffles prior to application of the cooling coolant in order to minimize the reoccurrence of a surface air film which would adversely affect the efficiency of the heat transfer between the coolant and the grinding surface.

In the practice of the invention a hollow nozzle body includes an inlet for receiving a liquid coolant, and the nozzle body is located adjacent the grinding wheel grinding surfaces immediately prior to engagement of the wheel grinding surfaces with the workpiece. The nozzle body includes a first outlet disposed adjacent the grinding surface and oriented so as to direct a stream of coolant liquid upon the grinding wheel grinding surface at least partially counter to the direction of movement of the grinding surface. This flow of coolant liquid, so directed, will disrupt and remove the moving air film existing immediately adjacent the grinding surface, and also remove most of the loose metal and abrasive particles remaining on the grinding surface.

Immediately after removal of the surface air film and loose particles, the grinding surface enters a shielded recess defined in the nozzle body which includes baffles which discourage the reoccurrence of a moving air film, and as the grinding surface leaves the nozzle body recess a generous supply of coolant liquid is applied to the grinding surface which cools the grinding surface, and also flushes the workpiece to maintain its temperature at a low level during the grinding operation.

Usually, the periphery of the grinding wheel constitutes the wheel grinding surface, and the nozzle housing includes lateral portions to define a periphery receiving recess. The lateral portions are spaced apart a distance only slightly greater than the width of the grinding wheel periphery and a baffle plate defining the recess, and disposed adjacent the grinding wheel periphery also partially defines the outlets of the nozzle body.

In order to effectively remove the surface air film and loose particles from the periphery of the grinding wheel, the air film and loose particle removing nozzle is of a rectangular configuration which produces a thin sheet of coolant liquid of continuous existence throughout its width, and the width of the flow is at least equal to the width of the grinding wheel periphery being treated.

BRIEF DESCRIPTION OF THE DRAWINGS

The aforementioned objects and advantages of the invention will be appreciated from the following description and accompanying drawings wherein:

FIG. 1 is a somewhat schematic illustration of a typical grinding wheel installation using the nozzle of the invention, FIG. 2 is an enlarged, partially sectioned, elevational view of a liquid coolant grinding wheel nozzle in accord with the invention, and FIG. 3 is an elevational view of the nozzle of FIG. 2, as taken from the left thereof, the orientation of the grinding wheel being illustrated in dotted lines.

DESCRIPTION OF THE PREFERRED EMBODIMENT

The basic relationship of a nozzle in accord with the invention as utilized with a grinding wheel is illustrated in FIG. 1. The grinding wheel 10 is mounted upon rotatable shaft 12, and includes a circular periphery 14 and lateral sides 16. The workpiece is illustrated at 18, and in a centerless grinder machine tool workpiece support means, and other conventional accessories, not shown, will be utilized with the workpiece to maintain the same in the illustrated position. The coolant nozzle 20 is located immediately in front of the workpiece 18 with respect to the direction of rotation of the grinding wheel as indicated by the arrow 22. The supply of coolant liquid to the nozzle is through conduit 24 connected to a conventional pump, not shown, and the coolant applied to the wheel is collected in the reservoir 26, which supplies the coolant liquid pump for a recycling of the coolant liquid as is well known in the machine tool arts.

With reference to FIGS. 2 and 3, the nozzle 20 includes a nozzle body 28 which may be formed of sheet metal. The nozzle body includes spaced parallel lateral side portions 30, a rear wall 32, a baffle plate 34 and a threaded inlet collar 36 is welded to the nozzle body upper portion 38 for cooperation with the liquid coolant supply conduit 24.

The upper end 40 of the baffle plate 34 is spaced from the lower surface of the upper portion 38 to define a rectangular nozzle opening 42, FIG. 3, having a width equal to the spacing between the nozzle body lateral side portions 30.

At the lower regions of the nozzle the lower end 44 of the baffle plate 34 is spaced from the inner surface of the nozzle body rear wall 32 to define a rectangular outlet opening nozzle 46 having a width equal to the spacing between the lateral portions 30. As will be appreciated from FIG. 2, the lowermost region of the body rear wall is disposed inwardly at 48 in alignment with the outlet opening 46 to deflect the liquid coolant passing through the opening into direct engagement with the grinding wheel periphery 14.

As the lateral side portions 30 extend toward the grinding wheel 10 and shaft 12 a greater distance than the baffle plate 34, a recess 50 is defined by the lateral side portions extending to the left of the baffle plate, FIG. 2, and the baffle plate. The sides 16 of the grinding wheel are shown by the dotted lines shown in FIG. 3, which indicates that the spacing between the side portions 30 is slightly greater than the width of the grinding wheel permitting a portion 52 of the grinding wheel periphery to be closely received within the recess 50, and thereby effectively shielded from the atmosphere adjacent the nozzle body 28.

In operation, the grinding wheel 10 is rotated at its operating speed and pressurized liquid coolant is supplied to the nozzle body 28 through the conduit 24. The liquid pressure within the nozzle body causes a thin stream of coolant liquid to be ejected from the nozzle outlet opening 42. As apparent from FIG. 2, the direction of the coolant liquid ejected through outlet 42 will be parallel to the housing body upper portion 38, and the extension 54, extending toward the wheel periphery, assures that the intended direction of fluid flow will be maintained. While the direction of the fluid flow through outlet 42, as parallel to portion 38, is not tangental to the grinding wheel periphery 14, the direction is counter to the movement of the surface air film which exists immediately adjacent the grinding wheel periphery as represented by arrows 56. The fact that the liquid flow through outlet 42 is counter to the airflow direction permits the liquid to force its way "under" the surface air film 56 and deflect the air film upwardly and away from the wheel periphery as represented by the arrows 58.

In addition to removing the surface air film from the grinding wheel periphery, the coolant liquid also flushes and washes loose metal and abrasive particles from the periphery surface as the direction of liquid flow is counter to the movement of the grinding wheel, and thus an effective flushing action of the grinding surface is accomplished.

Immediately after the grinding wheel periphery is freed of its surface airflow and loose particles, the periphery enters the recess 50, and due to the close relationship between the lateral sides 30 and the sides 16 of the grinding wheel, and the relatively close relationship between baffle plate 34 and the wheel periphery, the reoccurrence of a surface air film adjacent the grinding wheel periphery is minimized prior to the wheel periphery being exposed to the cooling coolant impinging on the periphery by coolant liquid passing through outlet opening 46. As substantially no surface air film exists on the grinding wheel periphery 14 when the coolant liquid passing through outlet 46 is applied to the periphery, an effective heat transfer takes place between the liquid and the periphery effective to reduce the peripheral temperature.

As the workpiece 18 is located immediately "behind" the nozzle body 28, no significant surface airflow has yet been recreated on the grinding wheel periphery and an effective application of cooling liquid to the grinding wheel periphery at the location of cutting occurs.

As the removal of the surface air film is accomplished by a jet of coolant liquid, the wear occurring at the grinding wheel to reduce the diameter thereof does not adversely affect the efficiency of the nozzle, and, of course, the support for the nozzle body will be periodically adjusted to maintain the nozzle body adjacent the grinding wheel periphery. Also, as the jet of coolant liquid formed by outlet opening 42 is of a continuous configuration throughout its width, and the width of the grinding wheel, a most effective removal of the surface air film, and loose particles from the periphery of the grinding wheel is achieved.

Of course, the inventive concepts of the invention may also be utilized with nozzles applying a coolant liquid to the sides of grinding wheels, if it is the side of the wheel which constitutes the grinding surface, and such modifications to the inventive concept well within the scope of one skilled in the art are considered to be within the scope of the invention.

I claim:

1. A grinding wheel cooling system characterized by its ability to remove the moving air film and loose particles adjacent the grinding surface of a rotating grinding wheel and apply a cooling liquid directly thereto comprising, in combination, a rotary grinding wheel having a grinding surface including a circular periphery and width, first nozzle means ejecting a first flow of cooling liquid directly on the grinding surface of the grinding wheel at a first surface location, said first nozzle means and thus said flow of cooling liquid being obliquely disposed to the grinding wheel grinding surface at said first surface location in a direction counter to the direction of movement of said grinding wheel surface at said first surface location to counteract and remove the moving film of air and loose particles adjacent said periphery at said first location, and said second nozzle means ejecting a second flow of cooling liquid upon said grinding wheel surface at a second surface location behind said first location with respect to the direction of grinding wheel surface movement to cool said grinding surface.

2. In a grinding wheel cooling system as in claim 1 wherein said first flow of cooling liquid comprises a stream of liquid having a width at least as wide as the grinding wheel width and of a thin dimension in the direction of grinding wheel rotation whereby said stream of liquid defines a blade of liquid to remove the wheel air film and loose particles.

3. In a grinding wheel cooling system as in claim 1, shielding and baffle means disposed adjacent said grinding wheel surface intermediate said first and second surface locations to minimize the reoccurrence of a moving air film adjacent said grinding wheel surface prior to the cooling liquid engaging said surface at said second location.

4. In a grinding wheel cooling system as in claim 1, a grinding location defined at a third location on the surface of said grinding wheel, said grinding location being adjacent to and behind said second location with respect to the direction of movement of said grinding wheel surface.

5. A grinding wheel cooling system characterized by its ability to remove the moving air film and loose particles adjacent the grinding surface of a rotating grinding wheel and apply a cooling liquid directly thereto comprising, in combination, a hollow nozzle body having an inlet for receiving liquid coolant, a first grinding wheel air film removing coolant outlet of a generally rectangular configuration producing a thin flat stream of coolant continuous throughout its width, and a second grinding wheel cooling coolant outlet, said first and second outlets being spaced from each other and oriented to direct coolant flow toward a grinding wheel grinding surface upon said nozzle body being located adjacent thereto, a recess defined in said nozzle body intermediate said first and second outlets of a width capable of receiving a portion of the grinding surface of a grinding wheel to partially shield such surface portion, said recess being defined by spaced lateral housing portions adapted to extend upon opposite sides of a grinding wheel periphery in close juxtaposition thereto and a baffle plate interposed intermediate said lateral housing portions, said baffle plate having first and second ends, said first and second ends partially defining said first and second outlets, respectively.

6. The method of cooling a rotating grinding wheel having a peripheral grinding surface with a liquid coolant comprising the sequented steps of removing the moving air film and loose particles adjacent the grinding wheel periphery by forming a thin stream of coolant of a width substantially equal to the wheel peripheral width, directing said stream of coolant onto the wheel grinding surface obliquely to the wheel surface and counter to the direction of wheel surface movement, shielding and baffling the grinding wheel surface after removal of the air film and loose particles, and applying a liquid coolant to the shielded grinding wheel surface.

* * * * *